United States Patent [19]

Kittredge, Jr. et al.

[11] Patent Number: 5,036,785

[45] Date of Patent: Aug. 6, 1991

[54] LIGHTNING PROTECTION INSTALLATION ON A BOAT

[76] Inventors: Robert L. Kittredge, Jr., 3312 Brentwood Ct., Punta Gorda, Fla. 33950; William M. Wagner, 11 Rimrock Dr., Belchertown, Mass. 01007

[21] Appl. No.: 448,632

[22] Filed: Dec. 11, 1989

[51] Int. Cl.[5] ..... B63B 43/00; B63B 15/00; B63B 41/00; H02G 13/00

[52] U.S. Cl. ..... 114/90; 114/127; 114/132; 114/138; 114/270; 174/2; 174/6

[58] Field of Search ..... 174/2, 3, 6; 114/343, 114/270, 90, 127, 132, 138; 343/707, 709, 710; 361/117, 131; 439/92, 131, 132

[56] References Cited

U.S. PATENT DOCUMENTS

| | | | |
|---|---|---|---|
| 11,217 | 7/1854 | Forbes | 174/2 |
| 1,858,336 | 5/1932 | Mirick | 343/709 X |
| 2,909,589 | 10/1959 | Booker | 174/6 |
| 3,483,305 | 12/1969 | Bonkowski et al. | 174/2 |
| 3,919,956 | 11/1975 | Invernizzi | 174/2 X |

*Primary Examiner*—Laramie E. Askin
*Attorney, Agent, or Firm*—Frank A. Lukasik

[57] ABSTRACT

A lightning protection installation for boats comprising a copper lightning rod mounted on the top of the mast or, in the case of a power boat, mounted on the deck, a copper wire attached to the rod and running downwardly to a point where it is attached to a retractable copper conductor. The copper conductor is retractable through a plastic or fiberglass tube or box molded or inserted in the hull or attached to a centerboard, if available. When the conductor is raised to the passive position, it is protected from the formation of marine growth; and when it is lowered, the conductor provides sufficient wettable electrical conducting grounding surface to conduct the lightning to water ground. Raising the conductor removes the slight drag caused by the grounded conductor.

6 Claims, 3 Drawing Sheets

LIGHTNING PROTECTION INSTALLATION ON A BOAT

BACKGROUND OF THE INVENTION

1. Field of the invention

The invention relates to lightning protection systems for boats and more particularly is concerned with a lightning rod mounted on the top of a mast and a copper wire attached to the rod and running down the mast where it is attached to a retractable ground.

1. Description of the Prior Art

A major problem in connection with boats is that sailboat masts and radio antennas normally utilized in boating serve as points of incipient receipt of lightning strikes which cause serious damage to electrical equipment and to the structure of the boat as well, not to mention injury or even death to those on board. In the absence of efficient, economical, and reliable lightning protectors, boat owners are reluctant to venture out onto open waters whenever there is even a slight possibility of thunderstorms. In areas such as Southwest Florida and the Chesapeake Bay, for example, the NOAA weather forecasts predict thunderstorms on a daily basis. Thus, the boat owner must either stay at home or risk the possibility of being struck by lightning. Boats are particularly at risk because the mast or antenna becomes the highest point on the water and the most likely to attract a lightning charge.

Prior art devices have been made in various forms including long flexible chains or links of metal as disclosed in U.S. Pat. No. 11,217 to Forbes, a fixed ground attached to the hull as shown in U.S. Pat. No. 2,909,589 to Booker, a lightning arrestor comprising a reel that is rotatably mounted on the base on the boat and has a cable wound t as disclosed in U.S. Pat. No. 3,483,305 to Bonkowski et al., or a ground plate as disclosed in U.S. Pat. No. 3,919,956 to Invernizzi. The prior art devices suffer from the same problem that all underwater objects suffer and that is the incrustation of barnacles or other marine growth which then become insulating material and prevents the discharge of the electrical current caused by lightning. If the ground of a lightning protection installation is an unpainted metal plate permanently attached to the hull of a boat beneath the water line, the plate will become covered with marine growth, greatly reducing its effectiveness as a ground. If, however, the plate is coated with anti-fouling paint, the paint will serve as insulation, so again the plate loses its effectiveness as a ground. By making the ground retractable, it would be in contact with the water for only short periods of time, and therefore can be left unpainted without its acquiring marine growth. A through-hull installation is preferable to an over-the-side installation because the lightning is led in a straight line from the masthead to ground. Also, it is quickly activated and less cumbersome than dragging a metal plate or a tube through the water made fast to a metal wire.

SUMMARY OF THE INVENTION

According to the invention, a lightning protection installation comprises a copper lightning rod mounted on the top of a mast, and a copper wire attached to the rod and running down the mast where it is attached to a retractable copper tube or plate. When not in use, the copper tube or plate can be retracted, to prevent marine growth.

An object of the invention is to provide a lightning protector for boats which will effectively minimize the tendency of lightning to damage the boat and instruments or injure persons thereon.

It is another object of the invention to provide a lightning protector for installation on a boat which is inexpensive to manufacture and to install and one which permits maximum ground area free of marine growth.

It is still a further object of the invention to provide a lightning protection installation with a retractable ground.

Another object of the invention is to provide a lightning protection installation with a ground which is retractable through a through tube or as the centerboard is raised.

A still further object of the invention is to provide a lightning protection installation with a ground which is retractable to prevent marine growth when raised.

These and other objects of the invention will become apparent to those skilled in the art to which the invention pertains when taken in light of the annexed drawings.

DESCRIPTION OF THE PREFERRED EMBODIMENT

Figure 1:
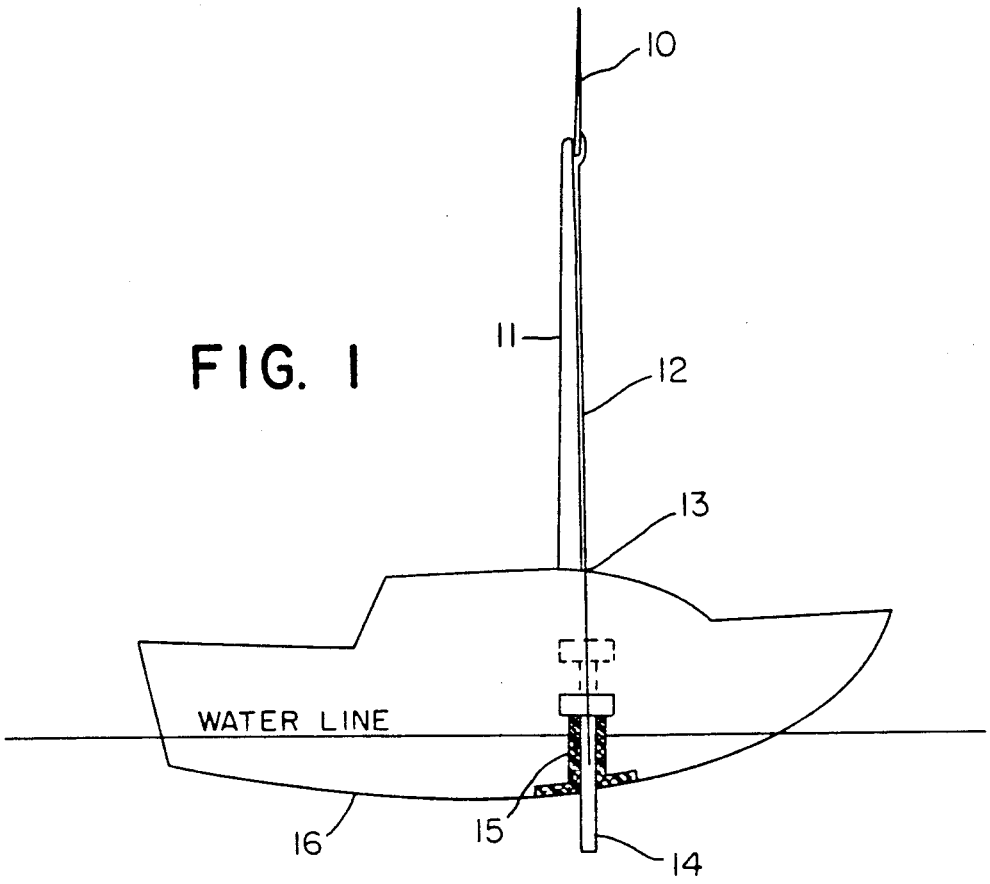
FIG. 1 is a schematic view of a lightning protection installation on a sailboat.

Referring now in more detail to the drawings, FIG. 1 shows a lightning rod 10 attached to but insulated from the top of a sailboat's mast 11 The lightning rod 10 is tapered at the top end and is affixed to the masthead at the bottom end. Lightning rod 10 projects at least two feet above the top of the mast 11. A connector 12, a copper wire or cable, runs as straight as possible down the mast, and is connected to the mast every few feet. The connector 12 is large enough to conduct a lightning bolt-at least #8 AWG- and is insulated from the mast all the way down to the ground 14. There is a through deck fitting (not shown) properly insulated in the deck 13 to which the connector 12 connects and disconnects at the base of the mast 11 so the mast can be removed without cutting the connector 12. The connector 12 running from the through-deck fitting to the ground 14 also connects and disconnects inside the cabin at the overhead, so the ground 14 and the connector 12 leading to it can be stowed out the way when not in use.

A receptacle 15 is provided in the form of a tube or box constructed of fiberglass or some other strong, non-metallic (non-conducting) material, e.g., a suitable plastic or porcelain. Receptacle 15 is molded or fixed securely to the bottom 16 of the boat and may be formed during hand lay-up of the boat hull similar to the construction of a centerboard trunk or installed after the boat is constructed in such a manner as to prevent water leaks. Receptacle 15 is lined with a liner 27 of a non-conducting material such as porcelain or glass or other suitable hard material, and it is positioned as directly as possible below the point where connector 12 enters the cabin so the lightning will run straight down the connector 12 to the ground 14 which is in the receptacle 15.

Figure 2A:
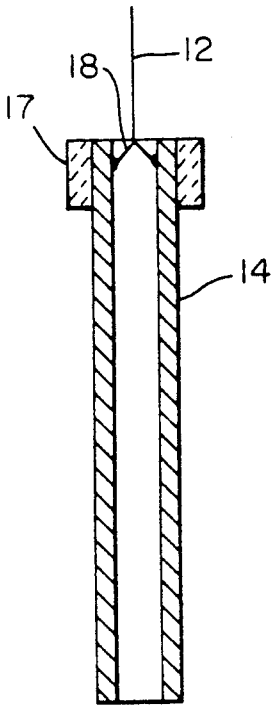
FIG. 2A is a sectional view of a retractable ground.
Figure 2B:
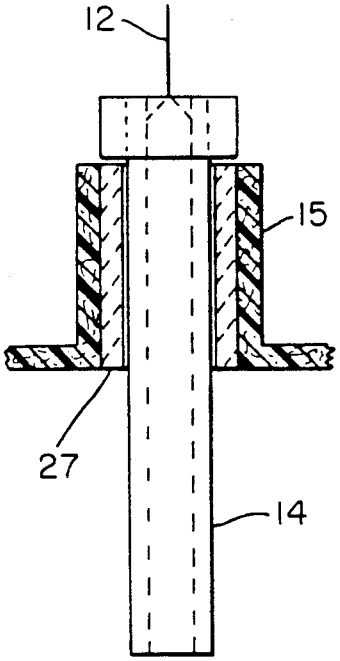
FIG. 2B is a sectional view of a receptacle containing the retractable ground of FIG. 2A.
Figure 2C:
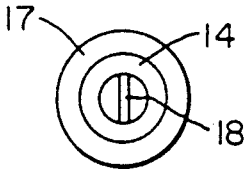
FIG. 2C is a top view of the retractable ground of FIG. 2A.

FIGS. 2A, 2B and 2C show the ground 14 as a copper tube having an inside diameter of about two inches and an outside diameter of about 2 ½ inches. The top of ground 14 is enclosed in a porcelain or other insulating material ring 17 so that both the ground 14 and the connector 12 are completely insulated between the cabin top and the receptacle 15 when the ground 14 is in the receptacle 15. The connector 12 is attached to the center of a copper strap 18, the ends of which are attached to the inside of the ground 14 (copper tube). The ground 14 should extend far enough below the bottom of the boat 16 to create a wettable electrical conducting surface area of at least one square foot.

Figure 3B:
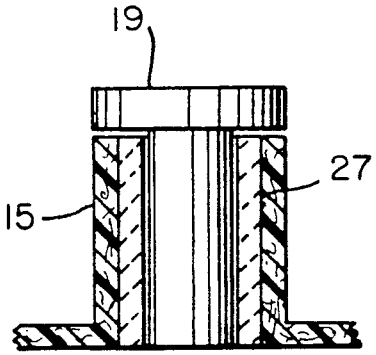
FIG. 3B is a sectional view of a receptacle plugged with the receptacle plug of FIG. 3A.
Figure 3A:
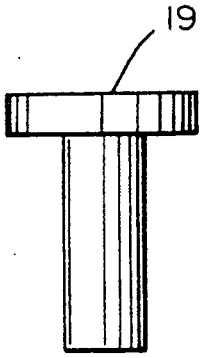
FIG. 3A is an elevational view of a receptacle plug.
Figure 3C:
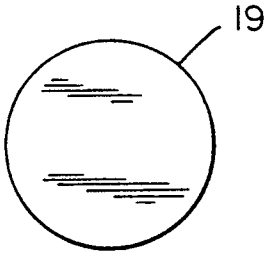
FIG. 3C is a top view of the receptacle plug of FIG. 3A.

When the ground 14 is retracted from receptacle 15, a plug 19, as shown in FIGS. 3A, 3B and 3C is inserted in receptacle 15 to keep the water out. The bottom of the plug 19 is contoured to the bottom of the boat and is painted with anti-fouling paint.

Figure 4A:
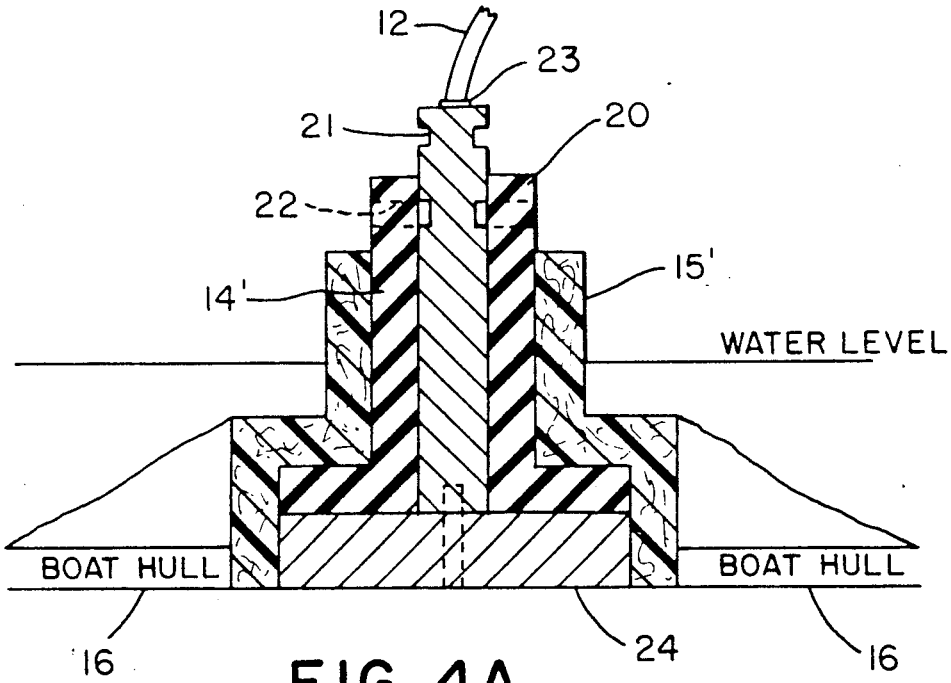
FIG. 4A is a sectional view of a second embodiment of the invention.
Figure 4B:
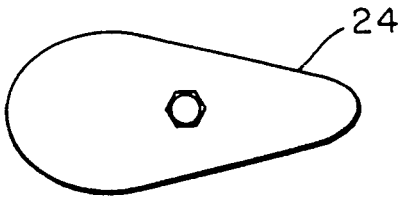
FIG. 4B is a bottom view of a grounding plate employed in the second embodiment of the invention shown in FIG. 4A.

FIG. 4A and 4B show another embodiment which includes a receptacle 15', a hard rubber insert 20 and a ground 14' having attached thereto a tear-drop-shaped grounding plate 24, the ground 14' and plate 24 being illustrated in a retracted position. Locking notches 21 formed in ground 14' are used to lock ground 14' with a, locking screw (not shown) in threaded hole 22 in insert 20. Connector 12 is attached to ground 14' at cable attachment 23. When the grounding plate 24 of ground 14' is in the "up" position or "inactive" position, the grounding plate 24 will fit into receptacle 15', flush with the contour of the boat bottom or keel, depending on the desired location. This embodiment will create less drag when sailing. The grounding plate 24 may be painted on the bottom to prevent marine growth. Hard rubber insert 20 provides insulation of the ground 14' and plate 24 from the receptacle 15 and the boat when ground 14' is extended. Insert 20 also creates a seal on the upper surface of the grounding plate 24 and outside surface of the ground 14'. The seal will prevent marine growth on the wetted surface.

When the ground 14' and the attached grounding plate 24 are "powered" or placed in the "active" position, the outside surface and the top surface of the grounding plate 24 are placed in contact with the water providing the ground. Adding the grounding plate 24 increases the surface available for water contact and thus increases the grounding potential. This will allow lowering of the ground 14' to a reduced depth, thus creating less drag.

Figure 5:
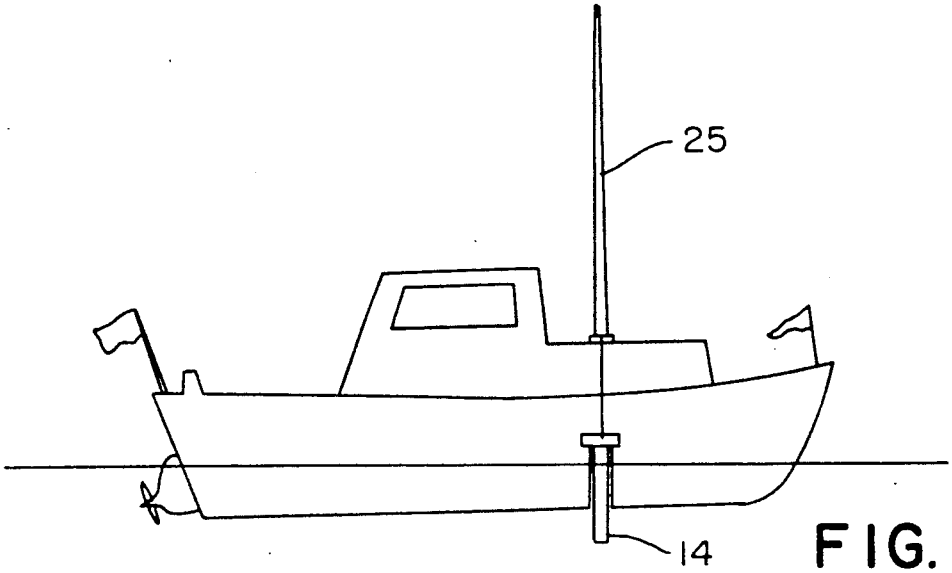
FIG. 5 is schematic view of a lightning protection installation on a powerboat.

FIG. 5 shows an embodiment of the lightning protection installation installed on a power boat which is identical to the below decks installation on a sailboat. Topside, if the power boat has no mast, a portable or collapsible lightning rod 25 of suitable length (at least 75% of the distance from the base of the rod to the bow or stern, whichever is greater) is erected and seated in a fitting on deck directly above the receptacle that receives the ground. As on a sailboat, the connector 12 is attached to this fitting on the overhead , where it can be connected and disconnected.

Figure 6B:
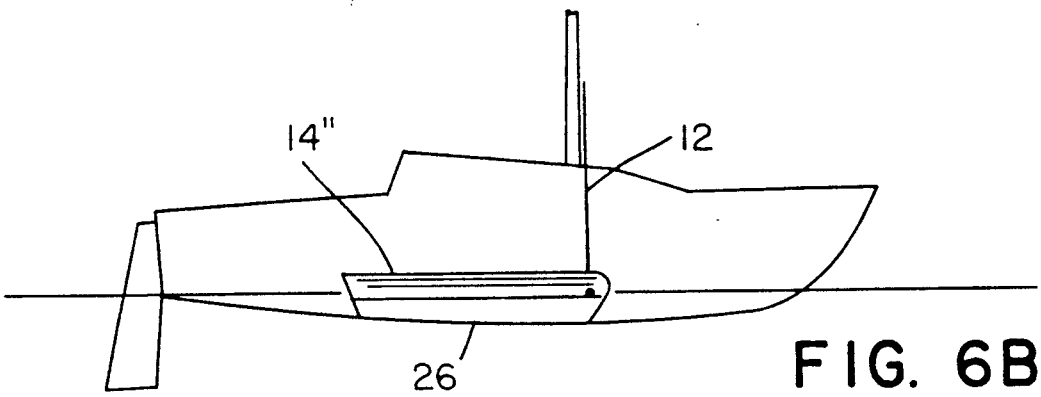
FIG. 6B is a schematic view of the embodiment of the invention shown in FIG. 6A in its retracted position.
Figure 6A:
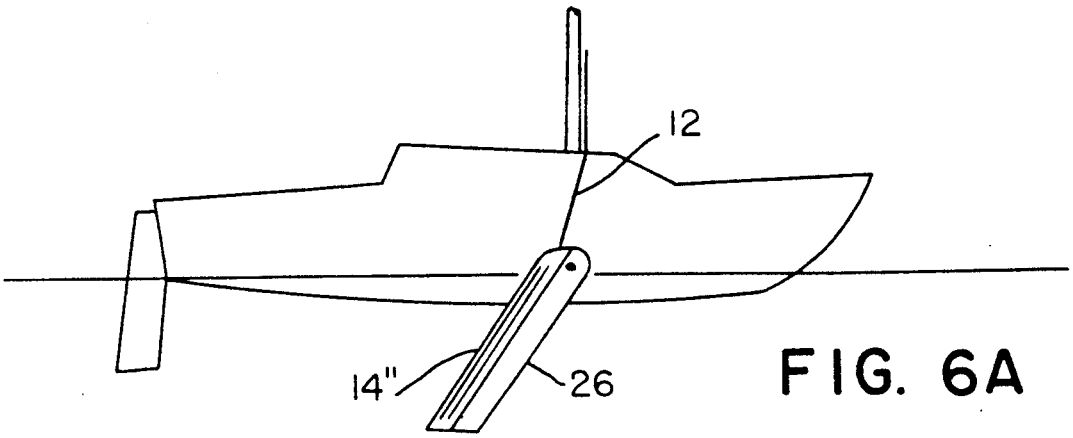
FIG. 6*a* is a schematic view of another embodiment of the invention in its extended position.

FIGS. 6A and 6B show a retractable ground 14" attached to a centerboard 26 on the trailing side (upper end when retracted into the centerboard well). When the centerboard 26 is extended (lowered), the ground 14" extends far enough below the bottom of the boat to create a wettable electrical conducting surface area of at least one square foot as described above. When the centerboard is retracted into the centerboard well, the retractable ground 14" is raised above the water level in the well and thus protected from marine growth, like ground 14 described above. Retractable ground 14" may be constructed of copper plate and attached to the fiberglass centerboard in a conventional way. The wettable (ground) surface should be equal to the area mentioned above. The connector 12 may be a more permanent connection below deck than the connection to ground 14 since it does not have to be easily disconnected.

In the instant invention, when lightning strikes the lightning rod 10 attached to thee top of a sailboat's mast or the temporary lightning rod 25 on a power boat, it then travels via a copper wire (connector 12), through the cabin top, and to a copper conductor (ground 14, 14', 14") which is located in the water about one foot below the bottom of the boat.

While the invention has been explained with respect to preferred embodiments thereof, it is contemplated that various changes may be made in the invention without departing from the spirit and scope thereof.

What is claimed is:

1. In a lightning protection installation on a boat, including a lightning rod, a ground, and a connector operatively attached to and extending between said lightning rod and said ground for grounding said lightning rod, the improvement wherein:

said ground comprises a receptacle in the boat, constructed of non-conducting material and fixed securely in a watertight manner to the bottom of said boat, and an electrical conductor adapted to be extended from said receptacle into an active position having a wettable electrical conducting surface of at least one square foot in contact with water ground and retracted into a passive position in said receptacle with said conductor protected from marine growth.

2. The combination set forth in claim 1 wherein said receptacle comprises a fiberglass tube lined with a non-conducting material and is adapted to slidably guide said electrical conductor between said active and passive positions.

3. The combination set forth in claim 2 wherein said electrical conductor comprises a copper tube having an insulating ring fixed at a first end and having a length and diameter to a second end sufficient to create said wettable electrical conducting surface area of at least one square foot in said active position.

4. The combination set forth in claim 1 wherein said receptacle comprises a fiberglass tube lined with a hard rubber insert, said rubber insert adapted to provide a tight fit for said electrical conductor when retracted into said passive position, and said electrical conductor being tear drop shaped and a side and upper surface area sufficient to create said wettable electrical conducting surface area of at least one square foot in said active position.

5. In a lightning protection installation for on a boat, including a lightning rod, a ground, and a connector operatively attached to and extending between said lightning rod and said ground for grounding said lightning rod, the improvement wherein said ground comprises:

a cylindrical copper conductor having an insulating ring fixed at a first end and having a length and diameter to a second end sufficient to create a wettable electrical conducting surface area of at least one square foot in an active position extended into water ground, and a receptacle having a fiberglass tube lined with a non-conducting material and fixed securely in a water manner to the bottom of said boat and adapted to slidably guide said conductor between said active position and a retracted passive position protected from marine growth.

6. In a lightning protection installation on a boat, including a lightning rod, a ground, and a connector operatively attached to and extending between said lightning rod and said ground for grounding said lightning rod, the improvement wherein:

said ground comprises a fiberglass centerboard well formed in said board and an electrical conductor comprising a copper sheet attached to a fiberglass centerboard of said board and being adapted to pivotally move said electrical conductor between a passive position in said well and into an active position in contact with water ground, said copper sheet having a length and width sufficient to create a wettable electrical conducting surface of at least one square foot in said active position.

* * * * *